United States Patent [19]

Ceelen

[11] Patent Number: 4,629,176

[45] Date of Patent: Dec. 16, 1986

[54] PAPER GRIPPER BAR

[75] Inventor: Theodorus M. Ceelen, Laverne, Calif.

[73] Assignee: Xerox Corporation, Stamford, Conn.

[21] Appl. No.: 679,428

[22] Filed: Dec. 7, 1984

[51] Int. Cl.[4] ..... B65H 29/02

[52] U.S. Cl. ..... 271/204; 271/85

[58] Field of Search ..... 271/204, 205, 206, 82, 271/85, 277, 268; 101/232; 226/158

[56] References Cited

U.S. PATENT DOCUMENTS

| | | | |
|---|---|---|---|
| 2,867,275 | 1/1959 | Laufer | 271/277 |
| 2,984,178 | 5/1961 | Koch | 101/409 |
| 2,991,998 | 7/1961 | Golding | 271/204 |
| 3,100,639 | 8/1963 | Brown | 271/205 |
| 3,502,324 | 3/1970 | Billhofer | 271/82 |
| 3,924,849 | 12/1975 | Murakami | 271/277 |
| 4,022,367 | 5/1977 | Sporenberg et al. | 226/158 |
| 4,058,307 | 11/1977 | Bubley et al. | 271/268 |
| 4,307,801 | 12/1981 | Hänsch | 198/695 |
| 4,526,100 | 7/1985 | Brasa | 271/204 X |

*Primary Examiner*—George E. A. Halvosa
*Assistant Examiner*—Lawrence J. Goffney, Jr.
*Attorney, Agent, or Firm*—Robert E. Cunha

[57] ABSTRACT

An improved paper gripper bar is described. The upper and lower portions are made from extruded aluminum and hinge together for their entire length for greater stiffness. Two or three spring clips provide a bias for closing the bar. The paper is held between the bottom ends of the spring clips and the upper bar when the bar is in the closed position. Finally, the clips are assembled into grooves in the upper and lower portions so that no additional parts are required to maintain the gripper bar parts in their proper positions.

5 Claims, 11 Drawing Figures

FIG. 1
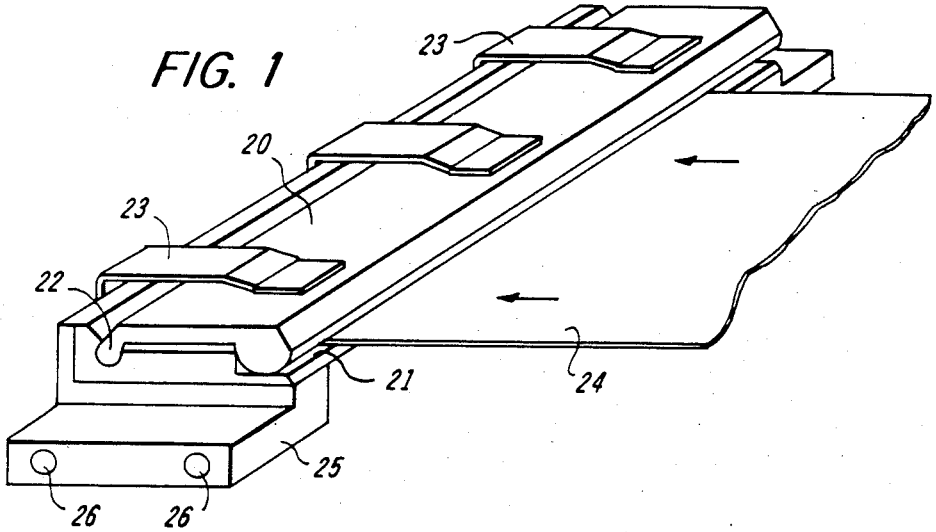
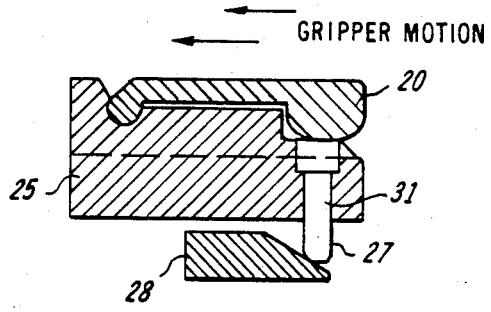
FIG. 2
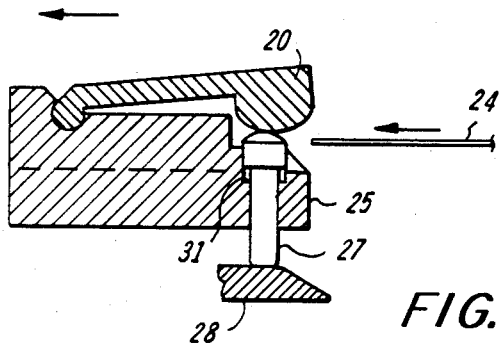
FIG. 3

PAPER GRIPPER BAR

This invention is a gripper bar for gripping the leading edge of a paper and for pulling it through the paper path of a copier or printer, and more specifically is a simplified gripper bar comprising an upper gripper, a lower gripper and two or three clips for holding the two grippers together and for gripping the paper.

BACKGROUND OF THE INVENTION

Gripper bars of various designs are commonly used in printers, copiers, duplicators, and the like, for gripping the leading edge of the paper and pulling it through the paper path. The gripper must hold the leading edge securely, but without damaging it. In addition, the gripper must be structurally stiff without being overly heavy, complex or expensive. The gripper must open wide enough to allow easy entry of the paper and then close on the paper without requiring extensive machinery for this opening and closing process. Finally, the bar must operate reliably through years of service.

SUMMARY OF THE INVENTION

The gripper bar described herein comprises upper and lower grippers held together by two or three spring clips. These grippers are single pieces of extruded aluminum, and therefore combine the properties of corrosion resistance, light weight and structural stiffness. To the extent that the other parts must be fitted to these members, the locations of the attachment points are either machined in or brazed on, both of these processes being common and simple machine shop operations. The grippers are also extruded in such a shape that the two bars fit together in the fashion of a hinge along their entire length, further enhancing their mutual stiffness.

The two grippers are held together with two or three spring steel clips which almost completely encircle the two grippers. These clips force the two grippers together to clamp down onto the paper. In fact, the actual points of contact between the gripper bar and paper occur between the ends of the lower portions of the clips and the adjacent points on the upper gripper.

The gripper bar is opened against the force of the spring clips to accept the paper by two cylindrical nylon pins, one at each end of the bar, which in turn are driven by a wedge shaped cam. In operation, the gripper bar is pulled along the paper path by a chain, and is opened and closed by being pulled over the stationary cams.

Ideally, the effective opening between members should be as wide as possible when the bar is open to lessen the chance of the paper missing the bar. In this case, the lower end of each clip and the upper gripper are shaped into a V-shaped entrance portion when the bar is open to minimize the possibility that the paper will not enter the bar properly.

BRIEF DESCRIPTION OF THE DRAWINGS

FIG. 1 is an overview of the entire gripper bar assembly.

FIGS. 2 and 3 are cross sectional end views of the gripper bar showing the pin for opening the gripper bar.

DETAILED DESCRIPTION OF THE INVENTION

Figure 4:
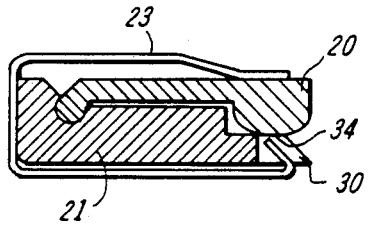
FIGS. 4 and 5 are cross sectional end views of the gripper bar showing the operation of the spring clips.

FIG. 1 is an overall view of the gripper bar. The upper gripper 20 is captured during assembly in the groove at the rear of the lower gripper 21 to form a hinge at axis 22. Two or three spring clips 23 bias the two grippers into contact with the paper 24. An end block 25 is brazed onto the end of the lower gripper 21. The two holes 26 in the end block 25 allow the attachment of the gripper bar to the driving chain by two pins.

FIG. 2 shows the construction of the opening mechanism. A nylong pin 27 is captured in a hole drilled into the end block 25. The hole 31 has a larger diameter at the top, as does the pin 27. The pin is therefore captured by the end block 25 and the upper gripper 20. The end block 25 is pulled along the track from right to left over the stationary cam 28 which engages the pin 27 to open the gripper bar. FIG. 3 is the same view, but in the open position.

Figure 5:
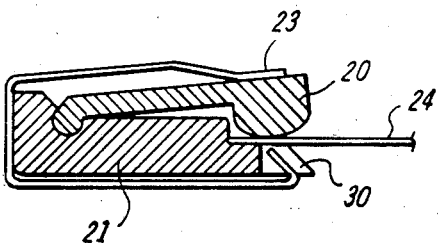

FIG. 4 is a cross sectional view showing the entire spring clip 23. The upper end of the clip is biased against the top of the upper gripper 20, and the lower end of the clip fits into a machined slot 30 in the lower gripper 21. The lower end of the clip 23 is bent upward and contacts the paper 24 between its end and the rounded portion of the upper gripper at contact point 34. FIG. 5 shows the gripper in a slightly open position, gripping a paper 24.

Figure 6:
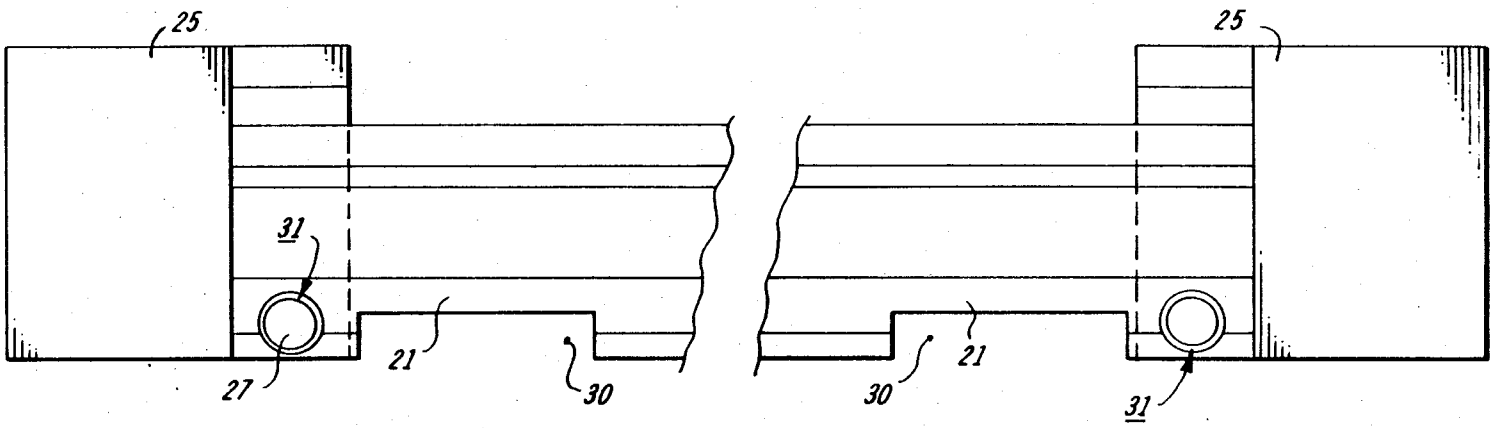

FIG. 6 is a top view of the lower gripper 21, in which the machined slot 30 has been cut. As can be seen from this view, the slot restrains the clip from moving to the right or left after assembly. Also shown in this view is the two diameters of the hole 31 in which the nylon pin 27 is contained. Finally, the end blocks 25 are brazed beneath the ends of the lower gripper 21 in the position shown.

Figure 7:
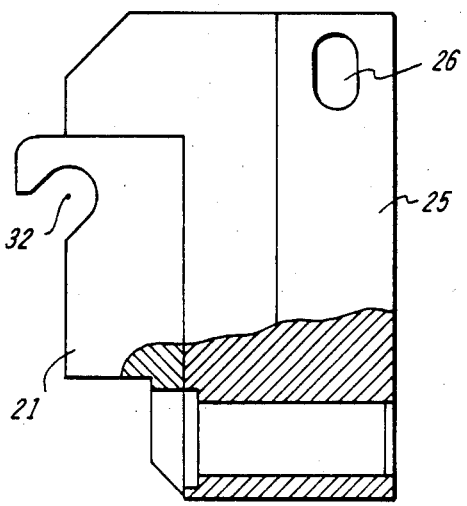
FIGS. 6 and 7 are views of the lower gripper.

FIG. 7 is an end view of FIG. 6. The groove 32 captures the rear portion of the upper gripper after assembly so that the upper and lower grippers effectively are rotatably joined together in a hinged relationship at this axis. One of the two holes 26 for the drive pins is shown. It actually is a slot since the pins are mounted on a chain, and the distance between pins is a bit shorter when the chain is traveling in an arc than it is when the chain portion is traveling along a straight section. Therefore, one hole is round to maintain position on the chain while the other is a slot to make up for the variation in distance.

Figure 9:
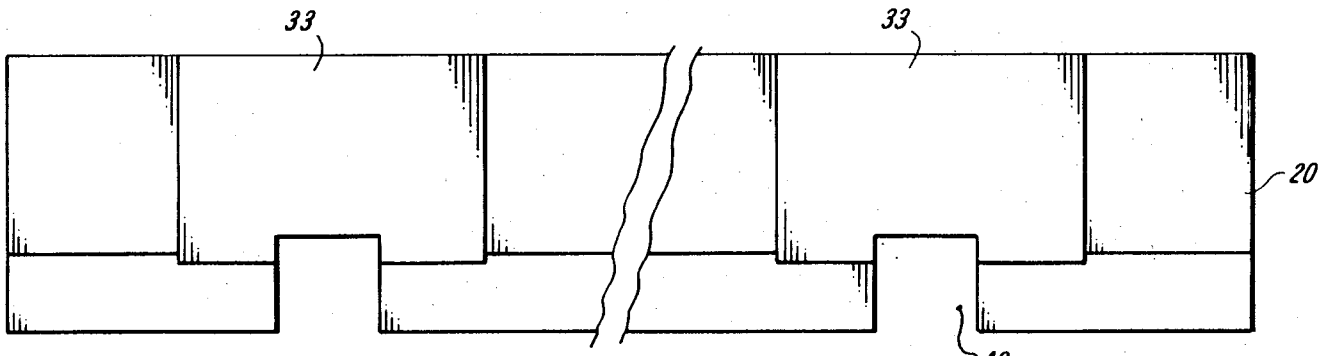
FIGS. 8 and 9 are views of the upper gripper.
Figure 8:
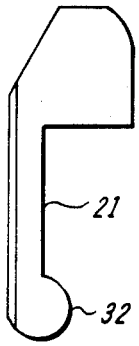

FIG. 8 is a cross section of the upper gripper 21. The rear portion 32 of this gripper is rounded to fit into the rear portion of the lower gripper. FIG. 9 is a top view of this upper gripper 20. There is a recessed portion 33 in the top of this upper gripper into which the top portion of the spring clip fits. The recess 33 is just deep enough to prevent the chip from sliding to the right or left.

Figure 10:
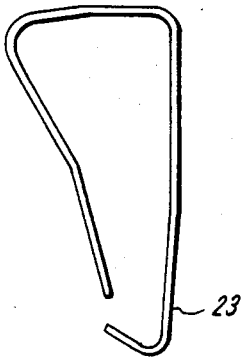
FIGS. 10 and 11 are views of the spring clips.
Figure 11:
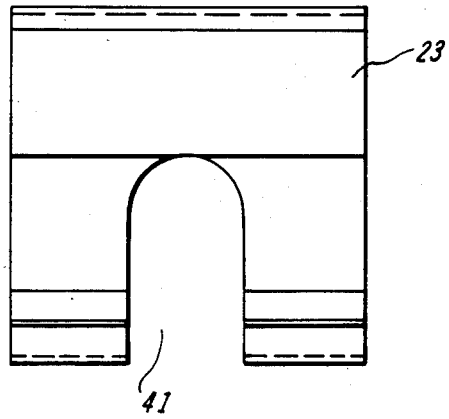

FIGS. 10 and 11 are side and bottom views of the stainless steel clip 23. In FIG. 10, the bottom of the clip is to the right. The bottom end is bent into a hook shape to engage the paper.

There are two slots 40 cut into the upper gripper 20 which line up with the slot 30 in the lower gripper 21 and with the slot 41 in the bottom of the spring clip 23 to form a continuous opening through the gripper bar, from top to bottom, in two places. This opening can be used, in conjunction with a light beam and a light sensor, to detect the presence of a paper in the gripper bar.

The slot 41 in the clip 23 also separates the bottom of the clip 23 into two separate spring loaded contacts for holding the paper.

While the invention has been described with reference to specific embodiments, it will be understood by those skilled in the art that various changes may be made and equivalents may be substituted for elements thereof without departing from the true spirit and scope of the invention. In addition, many modifications may be made without departing from the essential teachings of the invention.

What is claimed is:

1. A paper sheet gripper bar, for gripping a paper sheet, comprising:

an upper gripper and a lower gripper, each of said grippers extending the length of said sheet, and being fabricated from a single rigid piece of material, the rear edges of said grippers being shaped to interlock to form a hinge, a plurality of springs, each spring exerting a force tending to close the space between the front edges of the grippers, each of said springs comprising a flat piece of spring material bent into a shape which encircles the top, rear and bottom of said bar, and having a lower end further bent upward to grip the paper between said lower end and said upper gripper when the bar is closed on a paper.

2. The bar of claim 1 wherein the grippers comprise extruded aluminum.

3. The bar of claim 2 further comprising an end bar brazed to each end of said bar for coupling said bar to a means for transporting said bar along a paper path.

4. The bar of claim 1 further comprising a pin for opening said bar, extending through a hole in one gripper and contacting an inside edge of the other gripper, said pin being driven by a stationary cam in the paper path.

5. The bar of claim 1 wherein said grippers have machined depressions in which said springs are fitted during assembly, said depressions thus maintaining said springs in place.

* * * * *